US008616627B2

(12) United States Patent
Murphy et al.

(10) Patent No.: US 8,616,627 B2
(45) Date of Patent: Dec. 31, 2013

(54) GLIDING-RECLINING SEATING UNIT

(75) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 398 days.

(21) Appl. No.: 12/941,303

(22) Filed: Nov. 8, 2010

(65) Prior Publication Data

US 2012/0112518 A1 May 10, 2012

(51) Int. Cl.
*A47C 1/02* (2006.01)
*A47C 1/032* (2006.01)

(52) U.S. Cl.
USPC ..... 297/85 L; 297/83; 297/84; 297/271.1; 297/271.4

(58) Field of Classification Search
USPC ..... 297/83, 84, 85 L, 271.1, 271.4
See application file for complete search history.

(56) References Cited

U.S. PATENT DOCUMENTS

| | | | |
|---|---|---|---|
| 507,270 | A | 10/1893 | Hirschfeld |
| 2,526,623 | A | 10/1950 | Maurer |
| 2,714,922 | A | 8/1955 | McKibban et al. |
| 3,147,038 | A | 9/1964 | Barabas |
| 3,163,464 | A | 12/1964 | Martin |

(Continued)

FOREIGN PATENT DOCUMENTS

GB 2 106 777 A 4/1983

OTHER PUBLICATIONS

Lusch Brochure: "Functional Fitting and Tubular steel frames for Relaxing Chairs (11 pages), Functional Fittings for Sofabeds and Beds (10 pages), Bed Fitting (5 pages) and Upholstery joints and accessories for furniture (9 pages)", (available before Apr. 7, 2006).
"Stawett Functional Bed Mechanisms Brochure", pp. 3-93 (2001).

*Primary Examiner* — Philip Gabler
(74) *Attorney, Agent, or Firm* — Myers Bigel Sibley & Sajovec, P.A.

(57) ABSTRACT

A gliding-reclining seating unit includes: a base configured to rest on an underlying surface; an arm frame; a gliding mechanism attached to the base and to the arm frame, the gliding mechanism configured to enable the arm frame to reciprocate in a longitudinal direction relative to the base; a generally horizontally-disposed seat; a generally upright backrest positioned rearwardly of the seat; a footrest unit; and a reclining mechanism that interconnects and controls movement of the seat and the backrest relative to the frame between an upright position and a reclined position. In the upright position, the backrest is generally upright and positioned above the frame, and the seat has a first rearward position relative to the frame. In the reclined position, the backrest is reclined relative to the underlying surface as compared to its disposition in the upright position and the seat has a second forward position relative to the frame that is forward of the first rearward position. The footrest unit comprises at least one footrest and a footrest mechanism that interconnects the footrest with the seat. The footrest mechanism is configured to move the footrest between a retracted position, in which the footrest is positioned beneath the seat, and an extended position, in which the footrest is generally horizontally disposed in front of the seat, the footrest mechanism operating independently of the backrest mechanism. When the backrest moves between the upright and reclined positions, the footrest unit moves in concert with the seat relative to the frame. The arm frame is free to reciprocate relative to the base when the backrest is in either of the upright position and the reclined position.

18 Claims, 17 Drawing Sheets

(56) References Cited

U.S. PATENT DOCUMENTS

| | | | | | |
|---|---|---|---|---|---|
| 3,279,847 | A | | 10/1966 | Re | |
| 3,352,601 | A | | 11/1967 | Cycowicz | |
| 3,383,135 | A | | 5/1968 | Posh | |
| 3,493,264 | A | | 2/1970 | Re | |
| 3,622,198 | A | | 11/1971 | Re | |
| 3,622,202 | A | | 11/1971 | Brown | |
| 3,637,255 | A | | 1/1972 | Re | |
| 3,863,980 | A | | 2/1975 | Ciner | |
| 4,307,912 | A | | 12/1981 | Watt et al. | |
| 4,386,803 | A | | 6/1983 | Gilderbloom | |
| 4,519,647 | A | | 5/1985 | Rogers | |
| 4,674,794 | A | | 6/1987 | Pine | |
| 4,681,365 | A | | 7/1987 | Pine | |
| 4,682,815 | A | | 7/1987 | Steifensand | |
| 4,691,964 | A | | 9/1987 | Morgan | |
| 4,696,512 | A | | 9/1987 | Burnett et al. | |
| 4,707,025 | A | | 11/1987 | Rogers, Jr. | |
| 4,722,566 | A | | 2/1988 | Castellini | |
| 4,813,743 | A | | 3/1989 | Mizelle | |
| 4,915,444 | A | | 4/1990 | Rogers, Jr. | |
| 4,989,914 | A | * | 2/1991 | Pine | 297/85 L |
| 5,007,679 | A | | 4/1991 | Mizelle | |
| 5,086,769 | A | | 2/1992 | Vianello et al. | |
| 5,186,518 | A | * | 2/1993 | Pine | 297/85 L |
| 5,294,177 | A | | 3/1994 | Rasnick et al. | |
| 5,564,781 | A | | 10/1996 | Pine | |
| 5,704,686 | A | * | 1/1998 | May | 297/281 |
| 5,765,913 | A | * | 6/1998 | LaPointe et al. | 297/281 |
| 5,775,775 | A | | 7/1998 | Hoffman | |
| 5,876,094 | A | | 3/1999 | Hoffman | |
| 5,884,970 | A | | 3/1999 | Howard | |
| 5,931,535 | A | | 8/1999 | Sweet | |
| 5,954,392 | A | | 9/1999 | Liss et al. | |
| 6,000,754 | A | | 12/1999 | Lawson | |
| 6,135,559 | A | | 10/2000 | Kowaiski | |
| 6,145,924 | A | * | 11/2000 | Mero et al. | 297/68 |
| 6,231,120 | B1 | | 5/2001 | Wiecek | |
| 6,491,342 | B1 | | 12/2002 | Smith | |
| 6,540,291 | B2 | | 4/2003 | Hoffman et al. | |
| 6,612,650 | B1 | | 9/2003 | Ambrosio et al. | |
| 6,634,706 | B2 | | 10/2003 | May | |
| 6,733,071 | B2 | | 5/2004 | Guillot | |
| 6,945,599 | B2 | | 9/2005 | May | |
| 6,948,777 | B2 | | 9/2005 | Marshall et al. | |
| 7,021,711 | B1 | | 4/2006 | Hoffman et al. | |
| 7,040,692 | B1 | | 5/2006 | Pine | |
| 7,083,235 | B2 | | 8/2006 | Grimm et al. | |
| 7,188,904 | B2 | | 3/2007 | Bruck et al. | |
| 7,293,834 | B2 | | 11/2007 | Riach et al. | |
| 7,311,359 | B2 | | 12/2007 | Smith | |
| 7,322,650 | B2 | * | 1/2008 | Chouinard et al. | 297/270.2 |
| 2006/0082195 | A1 | | 4/2006 | Jiang | |

* cited by examiner

GLIDING-RECLINING SEATING UNIT

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

In recent years, furniture designers have looked for alternatives to rocking chairs that can provide a similarly relaxing repetitive motion. One alternative has been the gliding chair, or "glider", which includes structure that enables the seat portion of the chair to "glide" forwardly and rearwardly relative to its base to mimic generally the rocking motion of a rocking chair. Often the gliding structure comprises a set of swing links (usually two at the front of the chair, and two at the rear) that are pivotally attached at their upper ends to the base and extend downwardly therefrom to attach to a structure, such as a mounting bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs and thus are quite popular.

Reclining capability has been combined with gliding capability in a single unit to provide a chair that both reclines and glides. This chair includes a reclining mechanism that enables it to move between upright and one or more reclined positions, and further includes the aforementioned swing links attached between the base and the seat, armrests, or mechanism itself to enable the chair to glide. Examples of such chairs are illustrated and described in U.S. Pat. Nos. 4,536,029 and 4,544,201, both to Rogers, Jr., the disclosures of which are hereby incorporated herein by reference in their entireties.

Although they are already popular seating units, it may be desirable to provide additional functionality to glider-recliners.

SUMMARY OF THE INVENTION

As a first aspect, embodiments of the invention are directed to a gliding-reclining seating unit. The seating unit comprises: a base configured to rest on an underlying surface; an arm frame; a gliding mechanism attached to the base and to the arm frame, the gliding mechanism configured to enable the arm frame to reciprocate in a longitudinal direction relative to the base; a generally horizontally-disposed seat; a generally upright backrest positioned rearwardly of the seat; a footrest unit; and a reclining mechanism that interconnects and controls movement of the seat and the backrest relative to the frame between an upright position and a reclined position. In the upright position, the backrest is generally upright and positioned above the frame, and the seat has a first rearward position relative to the frame. In the reclined position, the backrest is reclined relative to the underlying surface as compared to its disposition in the upright position and the seat has a second forward position relative to the frame that is forward of the first rearward position. The footrest unit comprises at least one footrest and a footrest mechanism that interconnects the footrest with the seat. The footrest mechanism is configured to move the footrest between a retracted position, in which the footrest is positioned beneath the seat, and an extended position, in which the footrest is generally horizontally disposed in front of the seat, the footrest mechanism operating independently of the backrest mechanism. When the backrest moves between the upright and reclined positions, the footrest unit moves in concert with the seat relative to the frame. The arm frame is free to reciprocate relative to the base when the backrest is in either of the upright position and the reclined position.

As a second aspect, embodiments of the invention are directed to a gliding-reclining seating unit. The seating unit comprises: a base configured to rest on an underlying surface; an arm frame; a gliding mechanism attached to the base and to the arm frame, the gliding mechanism configured to enable the arm frame to reciprocate in a longitudinal direction relative to the base; a generally horizontally-disposed seat; a generally upright backrest positioned rearwardly of the seat; a footrest unit; and a reclining mechanism that interconnects and controls movement of the seat and the backrest relative to the frame between an upright position and a reclined position. In the upright position, the backrest is generally upright and positioned above the frame, and the seat has a first rearward position relative to the frame. In the reclined position, the backrest is reclined relative to the underlying surface as compared to its disposition in the upright position and the seat has a second forward position relative to the frame that is forward of the first rearward position. The footrest unit comprises at least one footrest and a footrest mechanism that interconnects the footrest with the seat. The footrest mechanism is configured to move the footrest between a retracted position, in which the footrest is positioned beneath the seat, and an extended position, in which the footrest is generally horizontally disposed in front of the seat, the footrest mechanism operating independently of the backrest mechanism. When the backrest moves between the upright and reclined positions, the footrest unit moves in concert with the seat relative to the frame. The footrest mechanism is actuated by a handle pivotally mounted to the seat, and the handle is positioned inboard of the arms.

DETAILED DESCRIPTION OF EMBODIMENTS OF THE INVENTION

Figure 1:
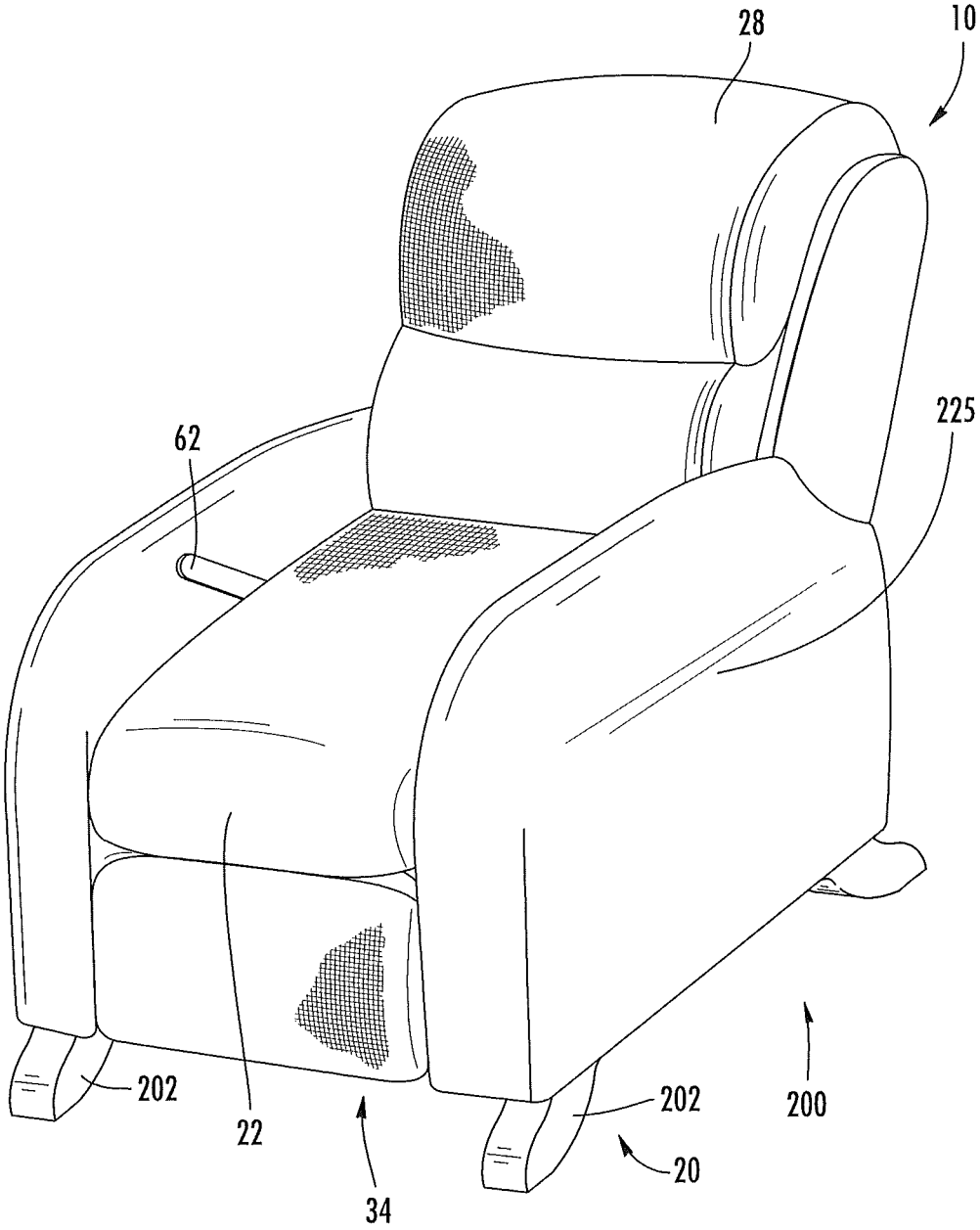
FIG. 1 is a perspective view of a gliding reclining chair according to embodiments of the present invention, with the backrest shown in an upright position and the footrest in a retracted position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to the drawings, a chair, designated broadly at 10, is illustrated in FIGS. 1-16B. The chair 10 includes a base 200, an arm frame 225, a seat 22, a backrest 28, a footrest unit 34, and two reclining mechanisms 40. These components identified above are described in greater detail below. As used herein to describe the relative positions of components, the terms "lateral", "outward" and derivatives thereof indicate the directions defined by a vector beginning at a vertical plane shown that bisects the chair 10 normal to the seat 22 and the backrest 28 and extending normal thereto (i.e., from the center of the chair 10 toward the arms). Conversely, the terms "inward", "inboard" and derivatives thereof indicate the direction opposite the "outward" direction. Together, the "inward" and "outward" directions comprise the "transverse" axis of the chair 10. The "rear" of the chair 10 is located at the tip of the backrest 28, and the "front" of the chair 10 is located at the end of the seat 22 farthest from the backrest 28. The "front" and "rear" directions comprise the "longitudinal" axis of the chair 10.

Figure 2:
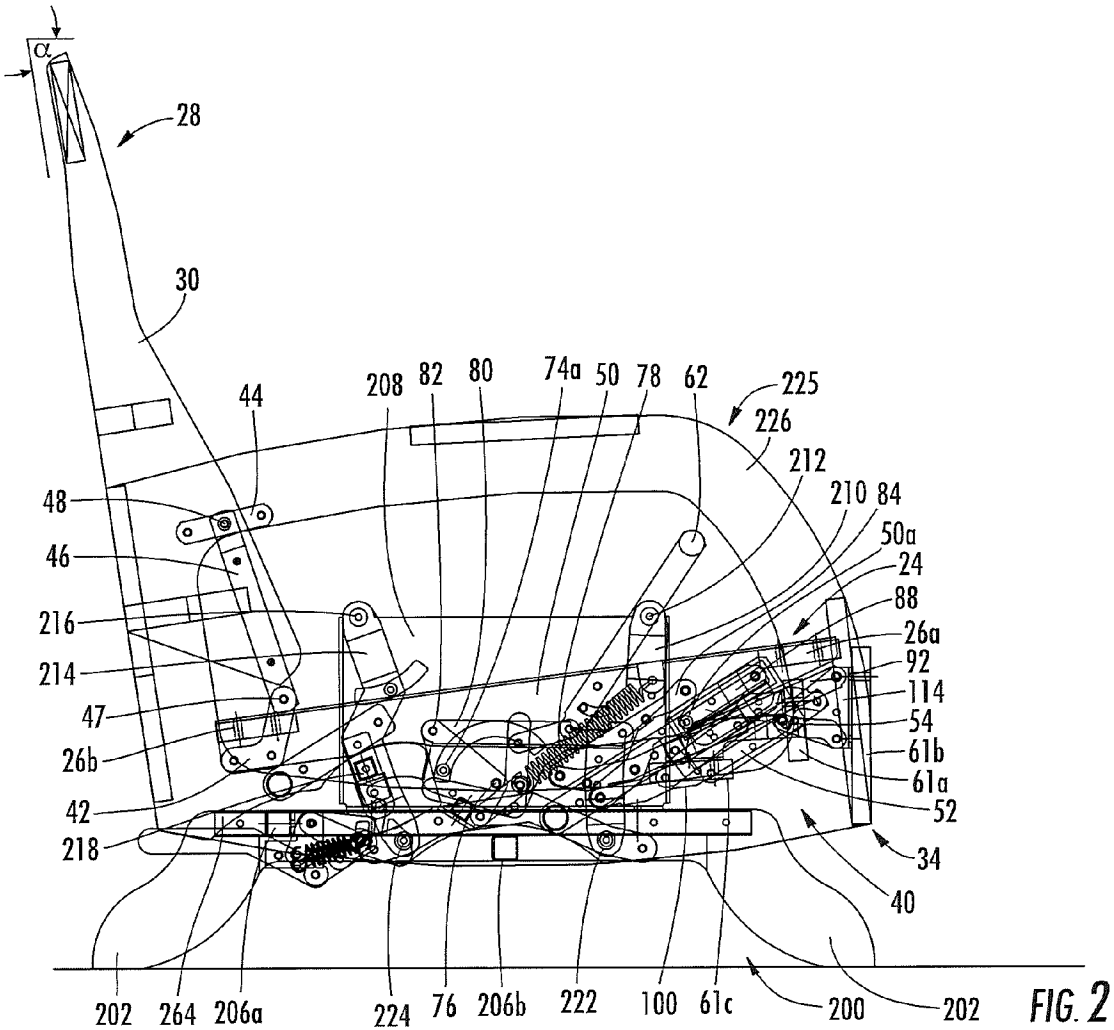
FIG. 2 is a cutaway side view of a reclining chair according to embodiments of the present invention, with the backrest in an upright position and the footrest in a retracted position.
Figure 3:
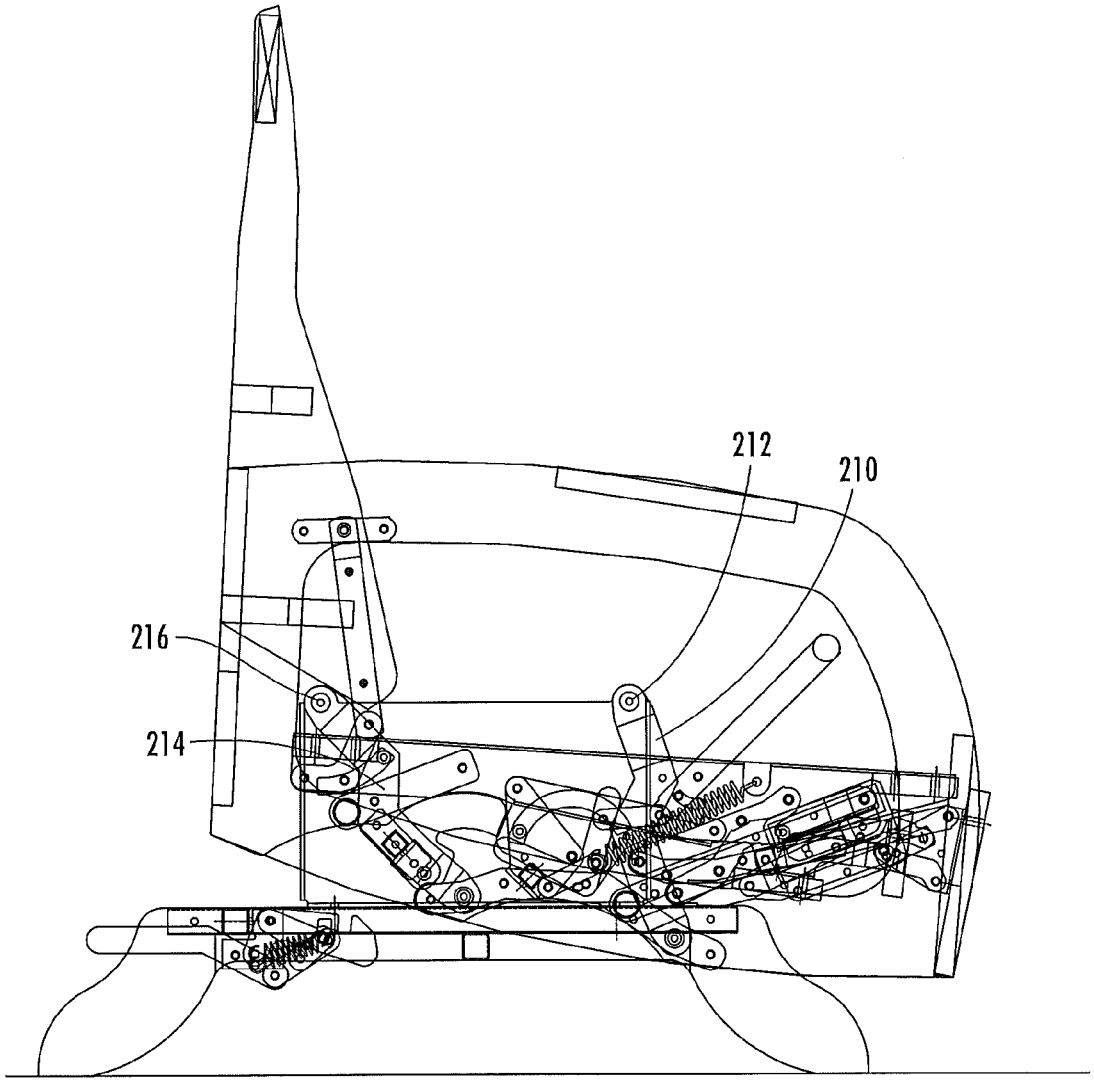
FIG. 3 is a cutaway side view of the chair of FIG. 1 in the position shown in FIG. 2, wherein the chair has glided forwardly relative to the base.
Figure 4:
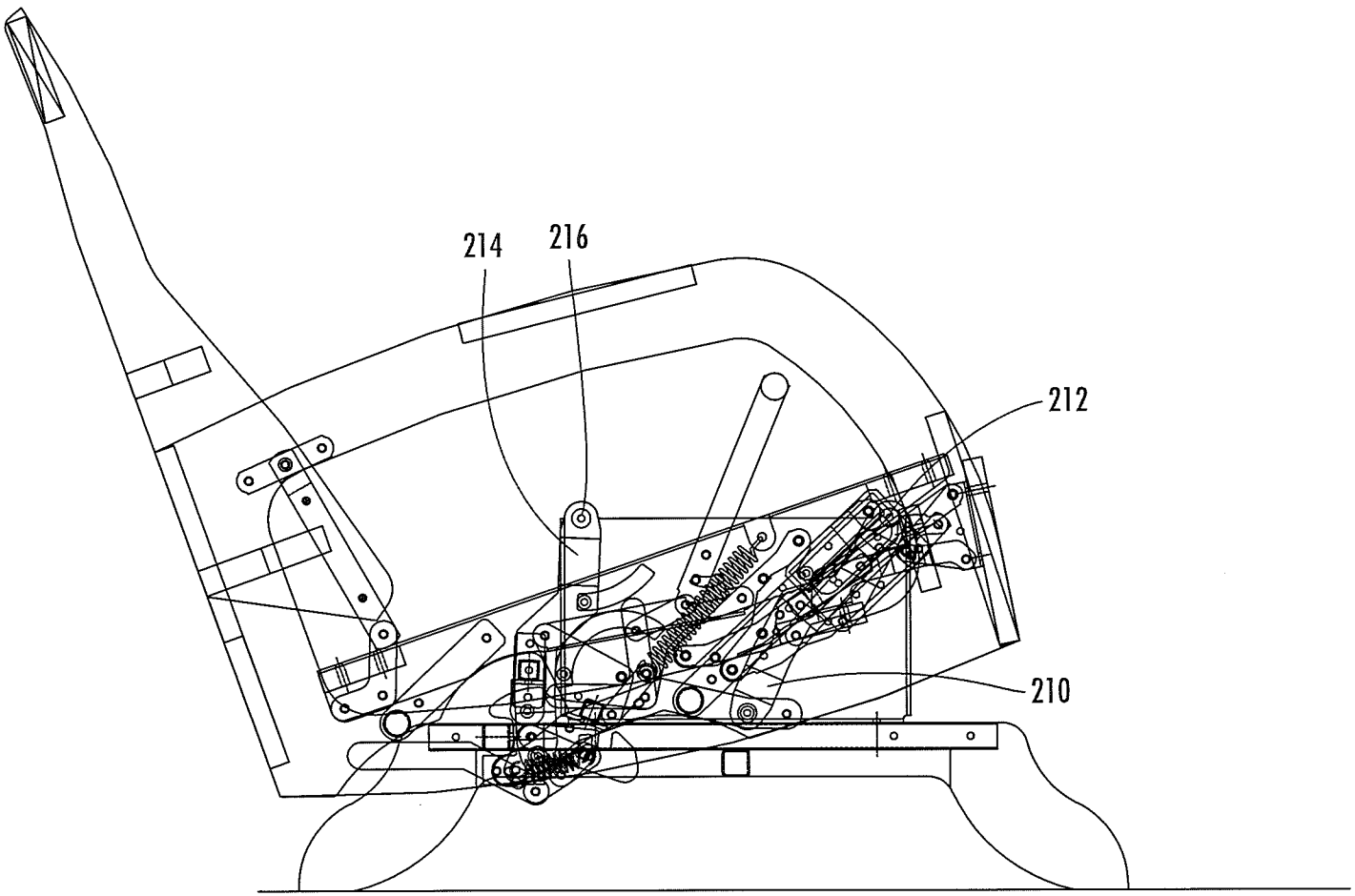
FIG. 4 is a cutaway side view of the chair of FIG. 1 in the position shown in FIG. 2, wherein the chair has glided rearwardly relative to the base.

Turning now to FIG. 2, the base 200 includes two longitudinally-extending foot members 202 that rest on the underlying surface. A base rail 204 is mounted to each foot member 202. Cross-members 206*a*, 206*b* span the base rails 204. A glide mount plate 208 is fixed atop each base rail 204. In the illustrated embodiment, the glide mount plate 208 is relatively tall, with its uppermost portions being between about 11 and 14 inches above the underlying surface (i.e., the floor). A front glide link 210 is attached at a pivot 212 to each mount glide plate 208 and extends downwardly therefrom. A rear glide link 214 is also mounted to each glide plate 208 at a pivot 216 and extends downwardly therefrom. A cross-member 218 spans the rear glide links 214 (see FIGS. 16A and 16B). A flange 219 depends from the cross-member 218 and includes a pin 219. The lower ends of the front and rear glide links 210, 214 are pivotally attached to a glide mounting link 220 at pivots 222, 224, respectively (FIG. 2). The distance between the pivots 212 and 222 is typically between about 6 and 10 inches, and the distance between the pivots 216, 224 is between about 6 and 10 inches.

Figure 15:
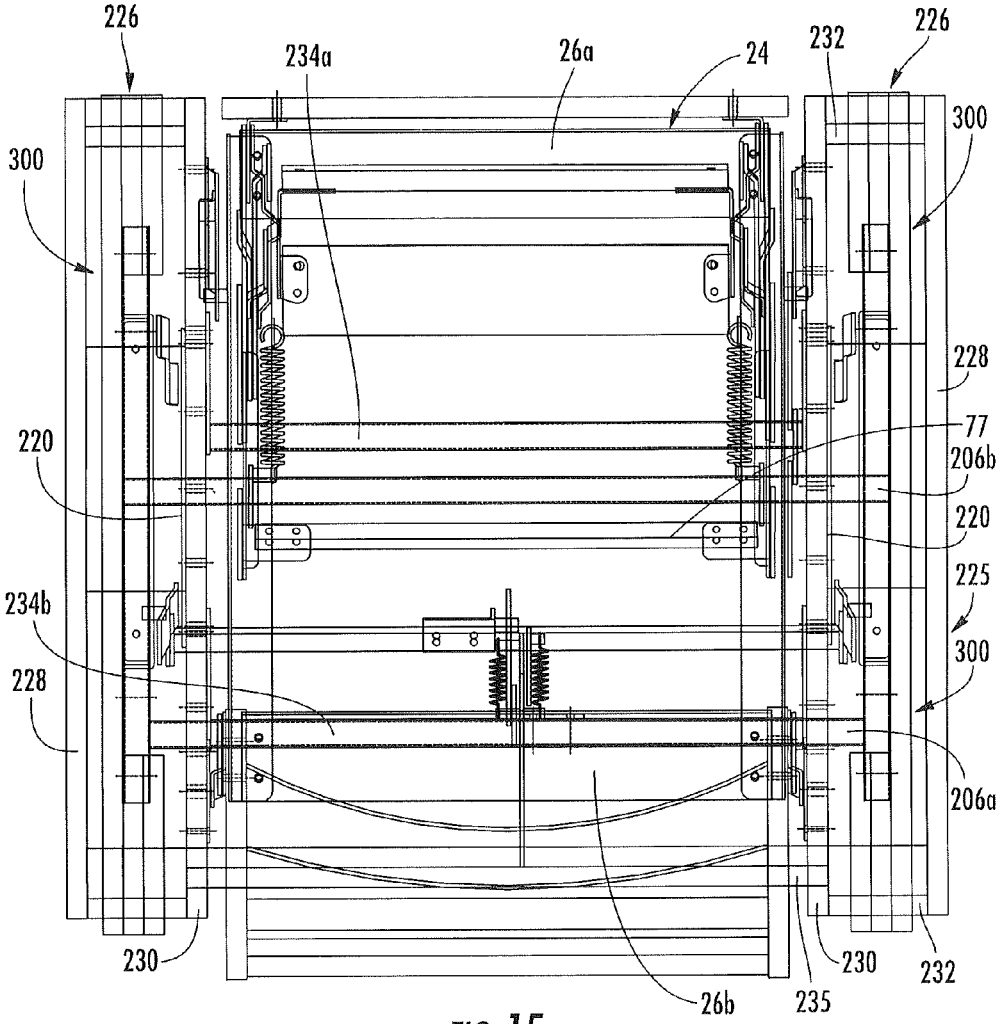
FIG. 15 is a cutaway top view of the chair of FIG. 1 with the backrest in an upright position and the footrest in a retracted position.

Referring to FIG. 15, the arm frame 225 includes two arms 226, only one of which will be described in detail herein. The arm 226 includes an outer panel 228 and an inner panel 230 that are connected by short bridge members 232. The inner panels 230 of the arms 226 are spanned by cross-members 234*a*, 234*b*, which are mounted to the inner surfaces of the inner panels 230, and by a cross-member 235, which is mounted to the rear edges of the inner panels 230, thereby forming a cavity 300. The glide mounting link 220 is mounted to the outer surface of the inner panel 230, thereby enabling the arm frame 225 to glide relative to the base 200.

Referring again to FIGS. 2 and 15, the seat 22 includes a seat frame 24 that is generally horizontally disposed between the arms 16, with a slight incline (typically between about 1 and 12 degrees) from rear to front. The seat frame 24 is formed by two cross-members 26*a*, 26*b* and two seat mounting brackets 50. The seat 22 is mounted to the arm frame 225 via a pair of reclining mechanisms 40, which are described in detail below.

The backrest 28 is disposed to be generally upright (with a typical angle $\alpha$ of between about 55 and 80 degrees to horizontal—see FIG. 2) above the rear portion of the base 200. The backrest 28 includes a frame 30 that is attached to the reclining mechanisms 40 (FIG. 2).

The reclining mechanisms 40 mount the seat 22 and the backrest 28 to the arm frame 225 and move the backrest 28 between an upright position (FIGS. 1-7), in which the backrest 28 is generally upright and positioned above the rear portion of the seat 22, and a reclined position (FIGS. 8-13), in which the backrest 28 is reclined relative to the upright position. The reclining mechanisms 40 are mirror images of one another about the aforementioned vertical bisecting plane; as such, only one reclining mechanism 40 is described herein, with the understanding that this discussion is equally applicable to the reclining mechanism on the opposite side of the chair 10. Also, the reclining mechanism 40 will be described first with respect to FIGS. 2 and 5, wherein the backrest 28 is in the upright position; a description of its movement to the reclined position (FIGS. 8 and 11) will then follow.

Figure 5:
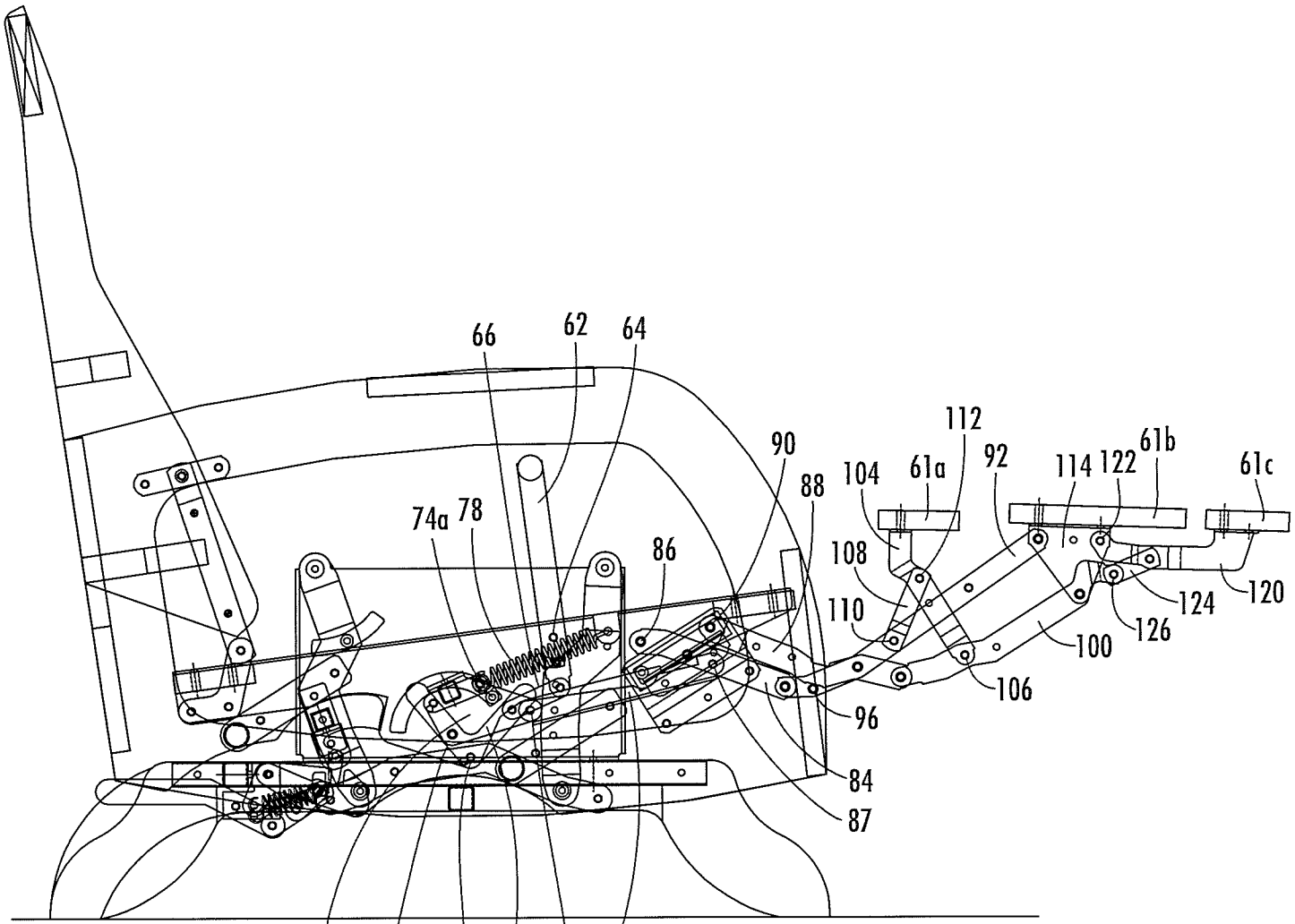
FIG. 5 is a cutaway side view of the reclining chair of FIG. 1 with the backrest in an upright position and the footrest in an extended position.
Figure 6:
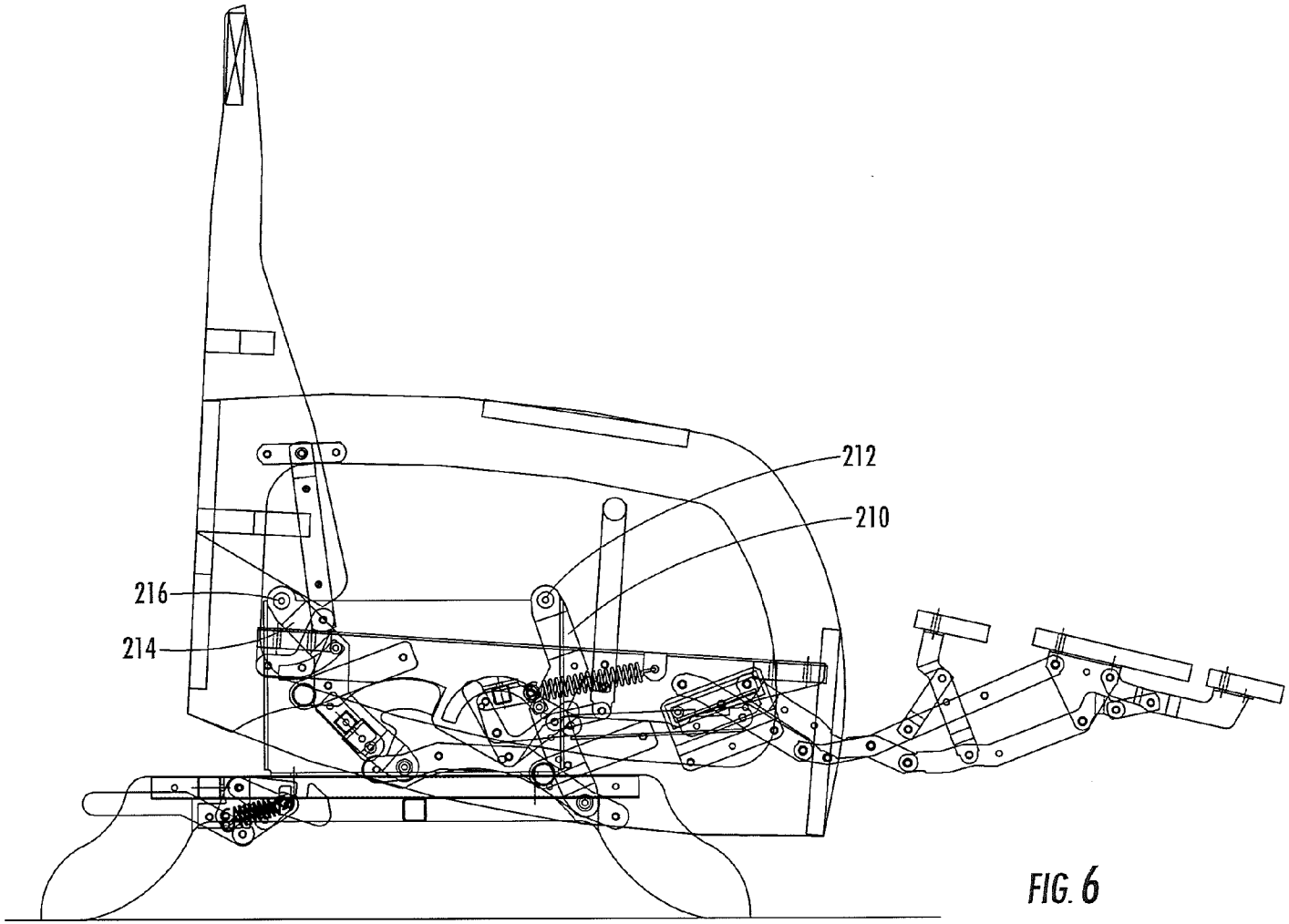
FIG. 6 is a cutaway side view of the chair of FIG. 1 in the position shown in FIG. 5, wherein the chair has glided forwardly relative to the base.
Figure 7:
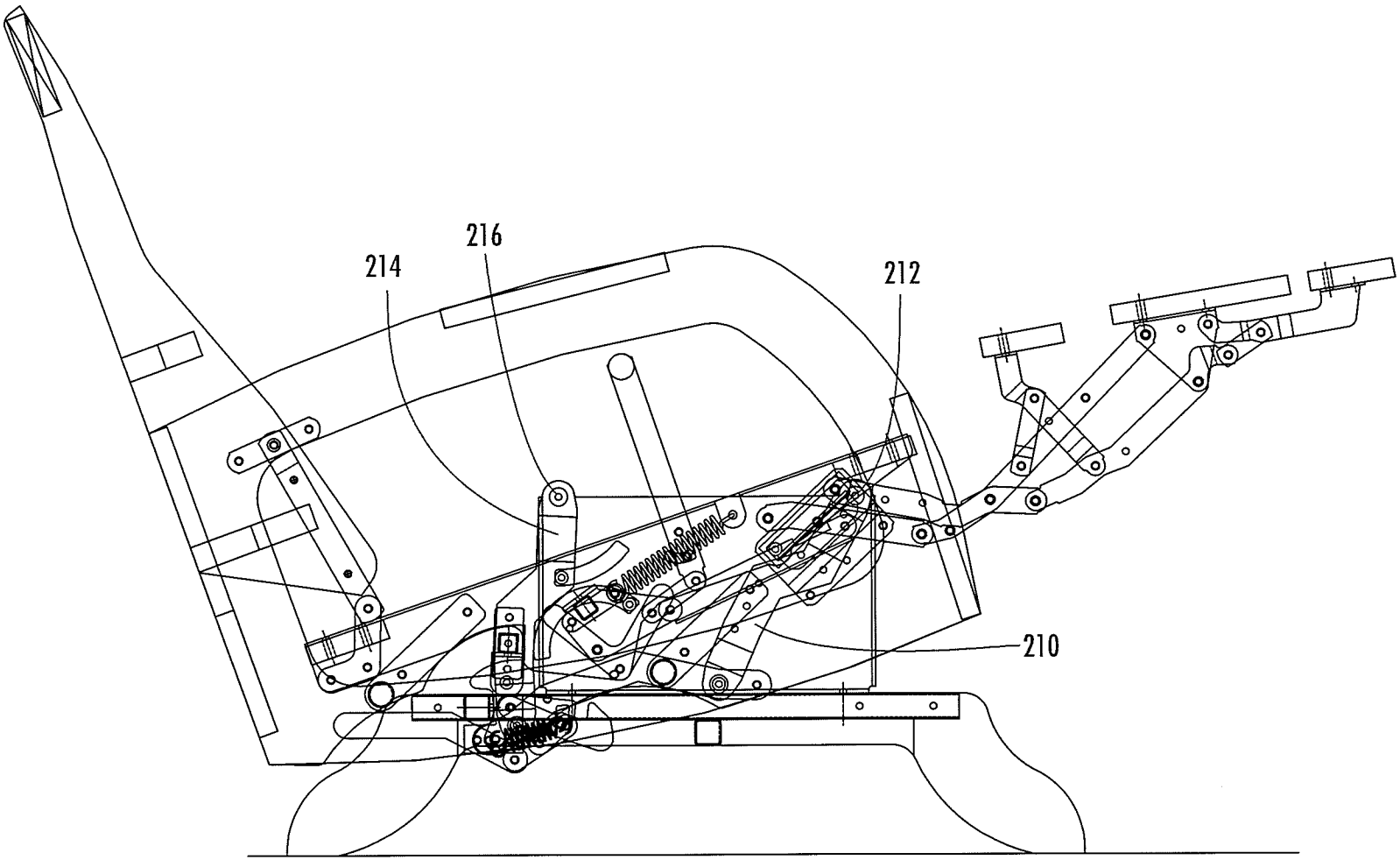
FIG. 7 is a cutaway side view of the chair of FIG. 1 in the position shown in FIG. 5, wherein the chair has glided rearwardly relative to the base.

As can be seen in FIGS. 2 and 5, the reclining mechanism 40 includes an L-shaped rear seat mounting bracket 42 that is mounted to the rear outer edge of the seat panel 24 and extends upwardly therefrom. A backrest mounting bracket 44 is fixed to the inner surface of the inner panel 230 of the arm frame 225. A coupling link 46 is fixed to the frame 30 of the backrest 28. The coupling link 46 is pivotally attached to the backrest mounting bracket 44 at a pivot 48 and extends downwardly and slightly forwardly therefrom to attach to the rear seat mounting bracket 42 at a pivot 47.

Still referring to FIGS. 2 and 5, the seat mounting bracket 50 includes a pin 50*a* on its outboard surface. A frame mounting bracket 52 is mounted to the inner surface of the inner panel 230 of the arm 226. The frame mounting bracket 52 includes a slot 54 that extends upwardly and forwardly and receives the pin 50*a* of the seat mounting bracket 50. In the upright position shown in FIG. 2, the pin 50*a* is located at the rear end of the slot 54 and prevents rearward movement of the seat 22 relative to the frame 12; gravity prevents forward movement of the seat 22 and backrest 28 relative to the arm frame 225.

Figure 8:
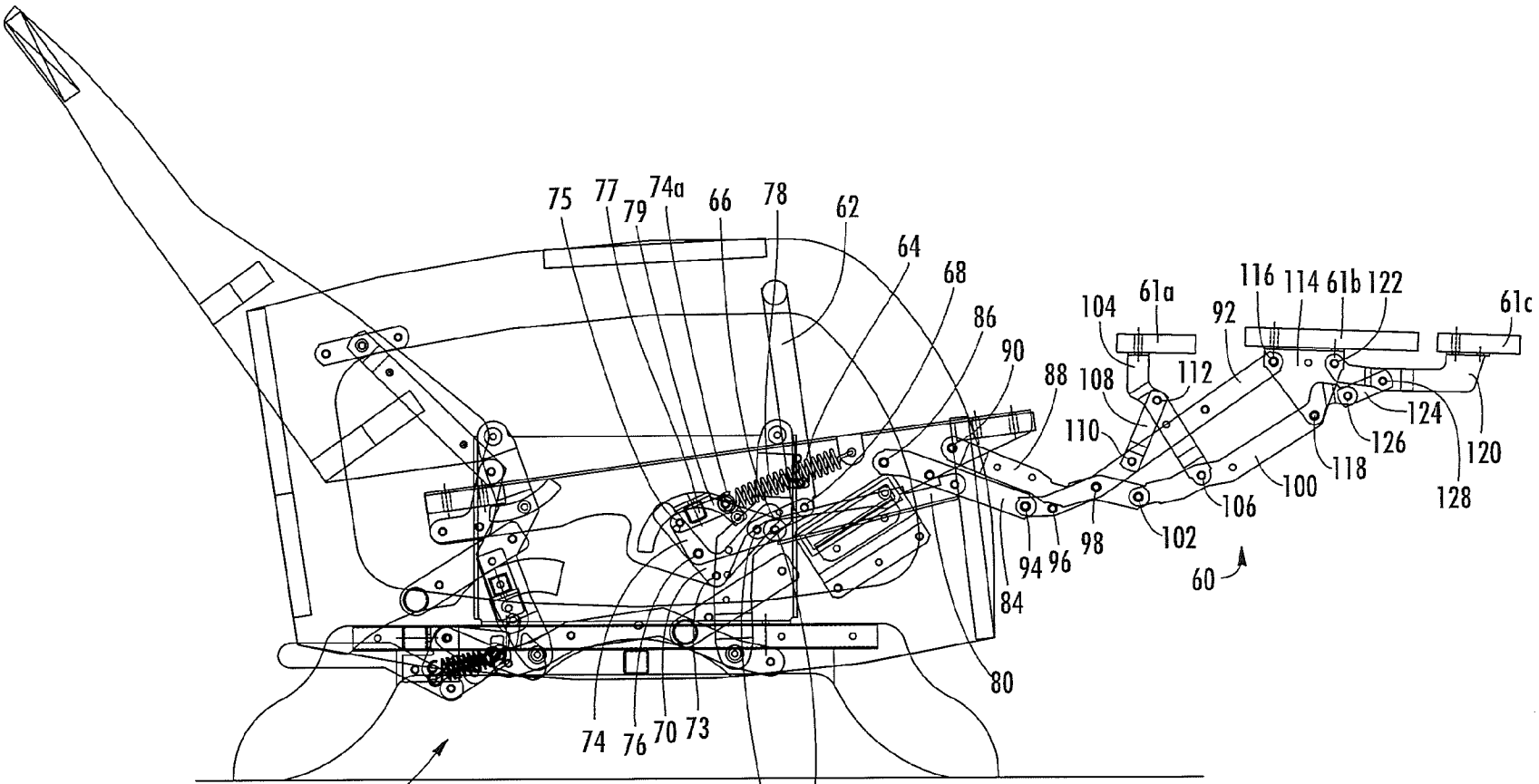
FIG. 8 is a cutaway side view of the reclining chair of FIG. 1 with the backrest in a reclined position and the footrest in an extended position.
Figure 9:
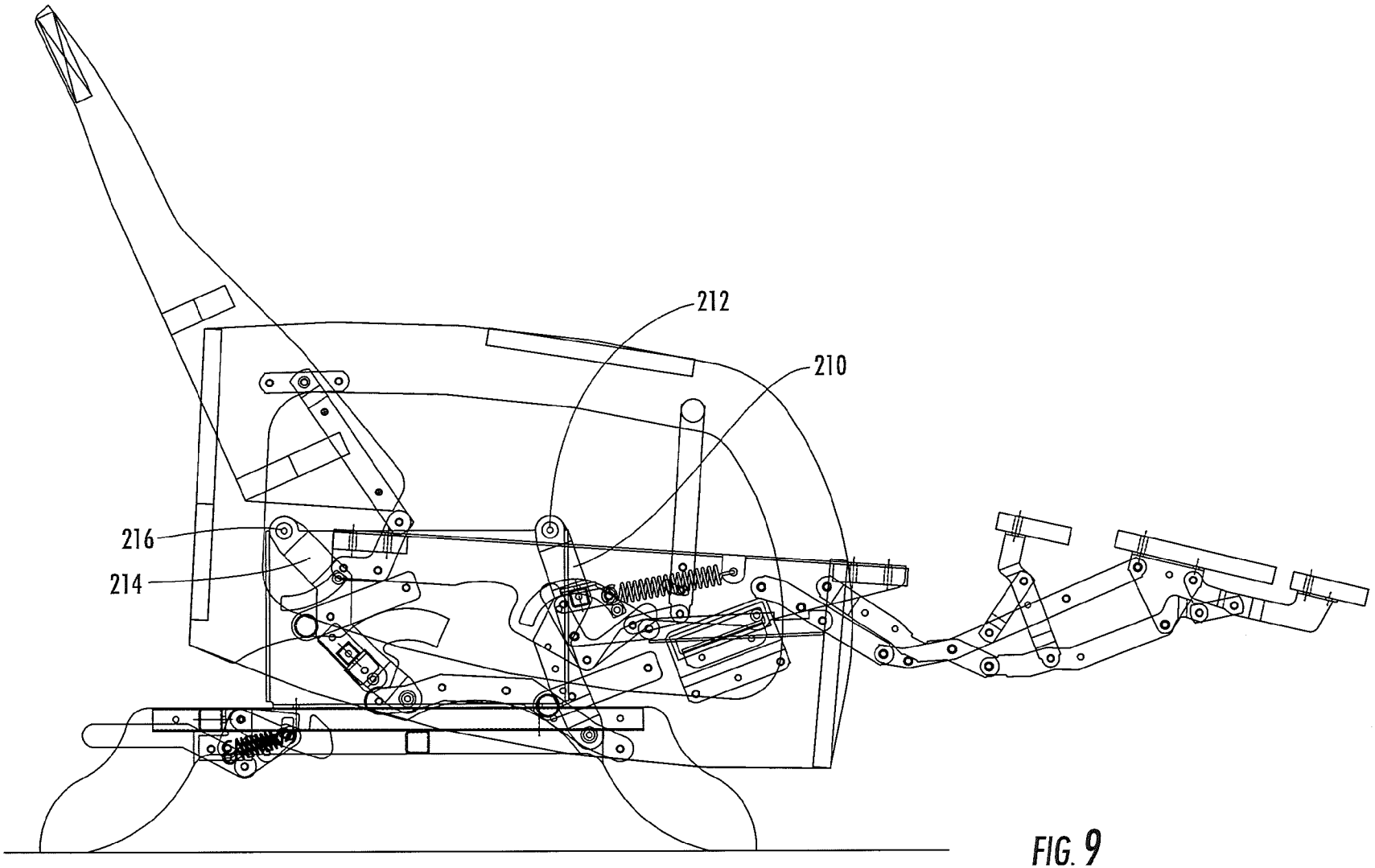
FIG. 9 is a cutaway side view of the chair of FIG. 1 in the position shown in FIG. 8, wherein the chair has glided forwardly relative to the base.
Figure 10:
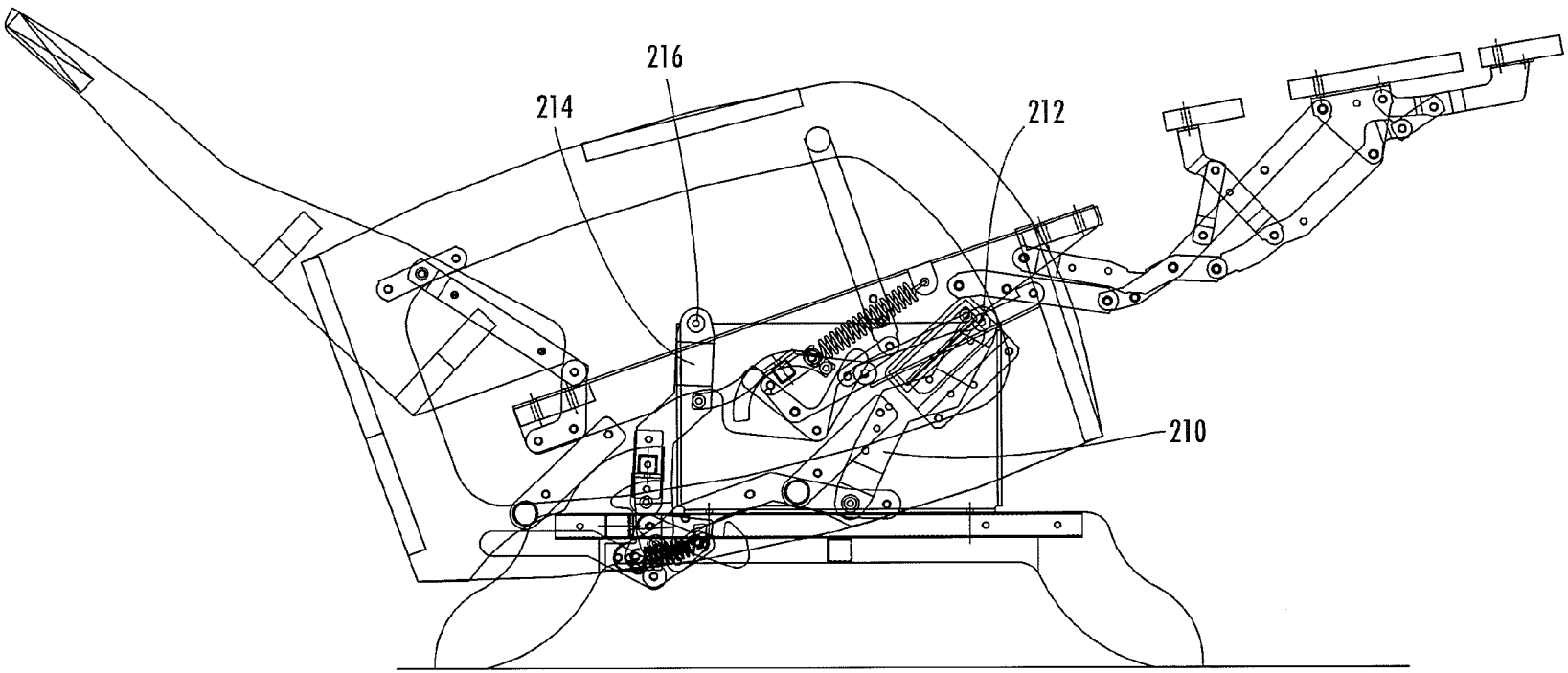
FIG. 10 is a cutaway side view of the chair of FIG. 1 in the position shown in FIG. 8, wherein the chair has glided rearwardly relative to the base.
Figure 11:
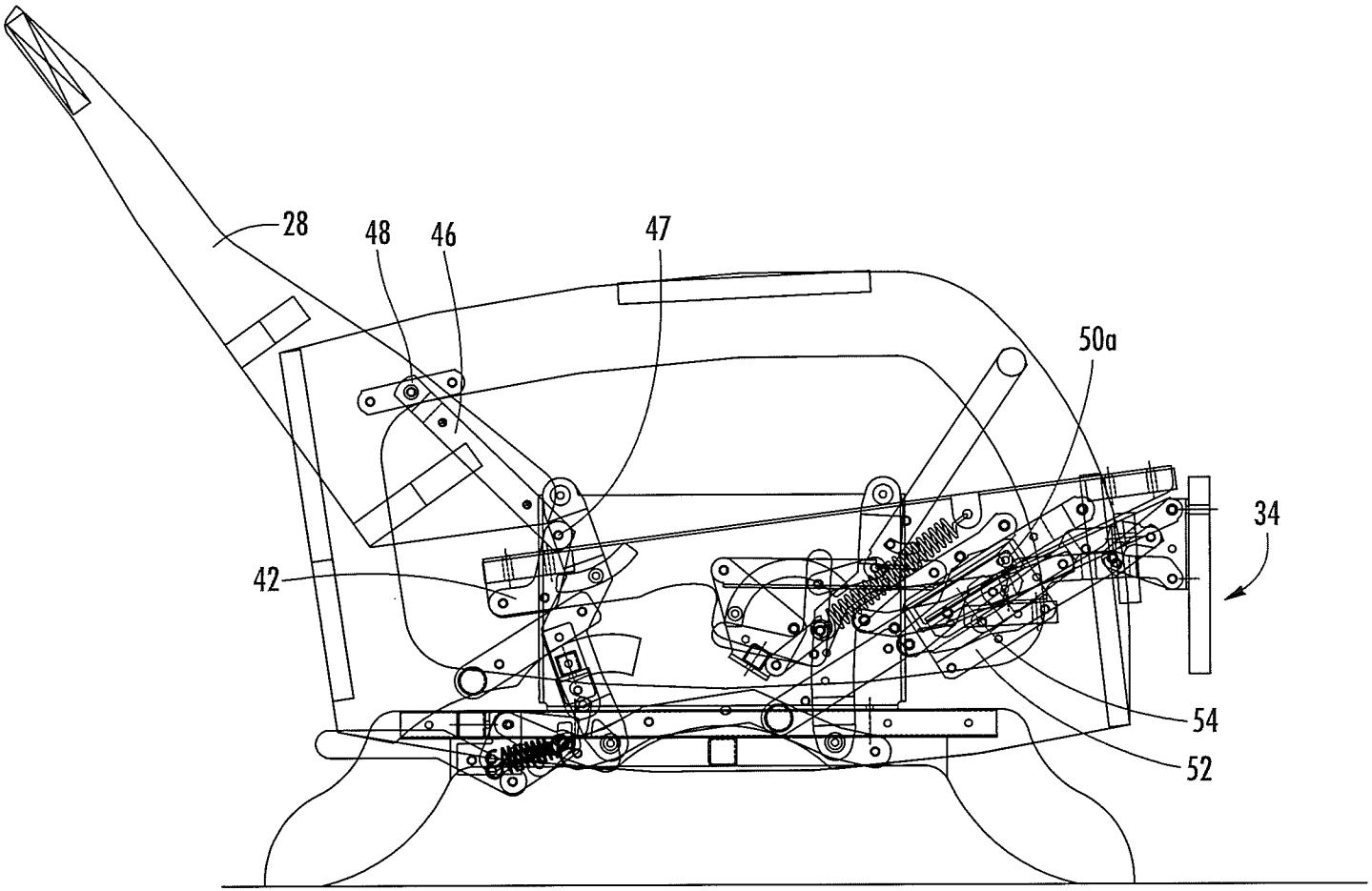
FIG. 11 is a cutaway front view of the reclining chair of FIG. 1 with the backrest in an upright position and the footrest in a retracted position.
Figure 12:
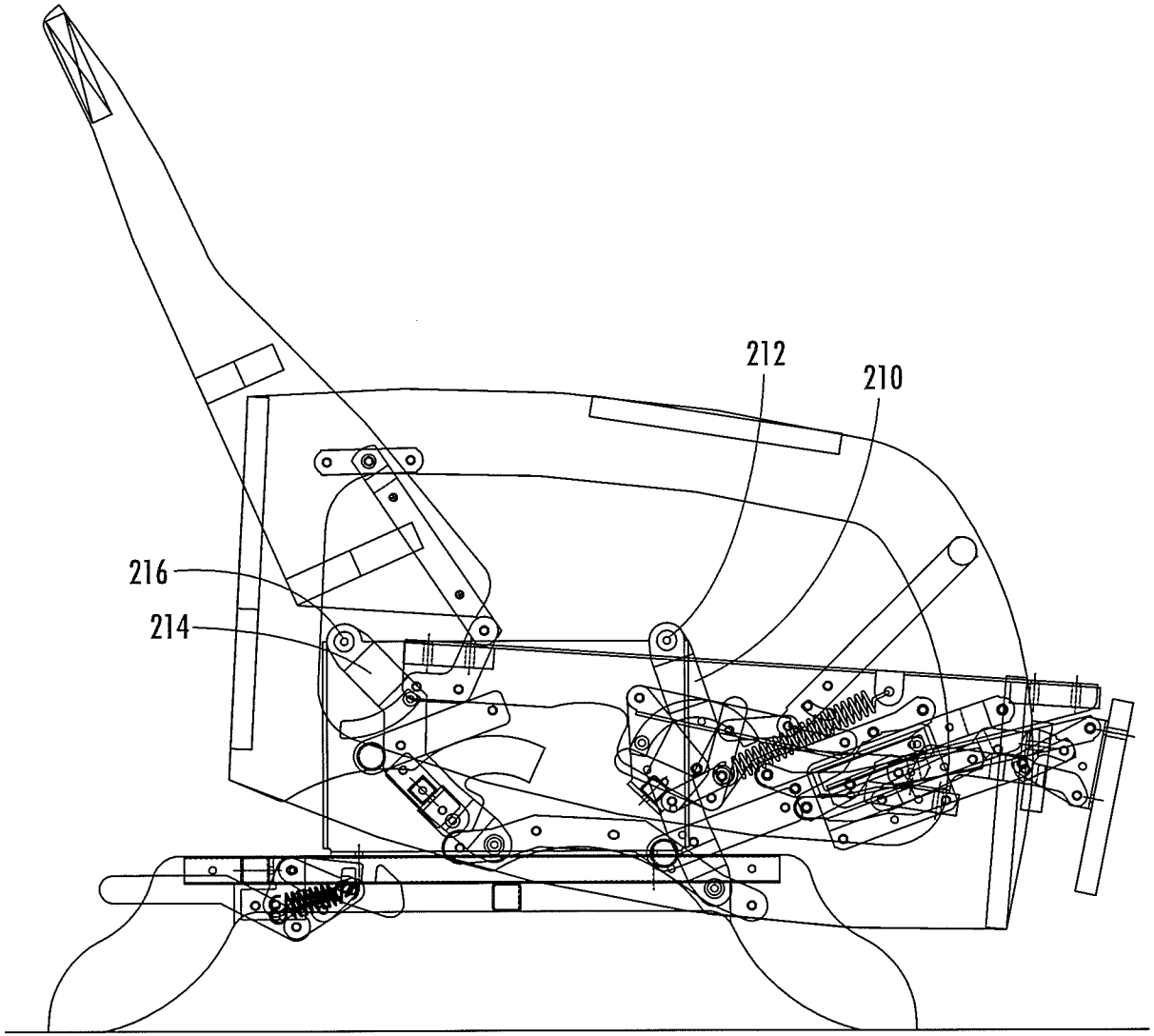
FIG. 12 is a cutaway side view of the chair of FIG. 1 in the position shown in FIG. 11, wherein the chair has glided forwardly relative to the base.
Figure 13:
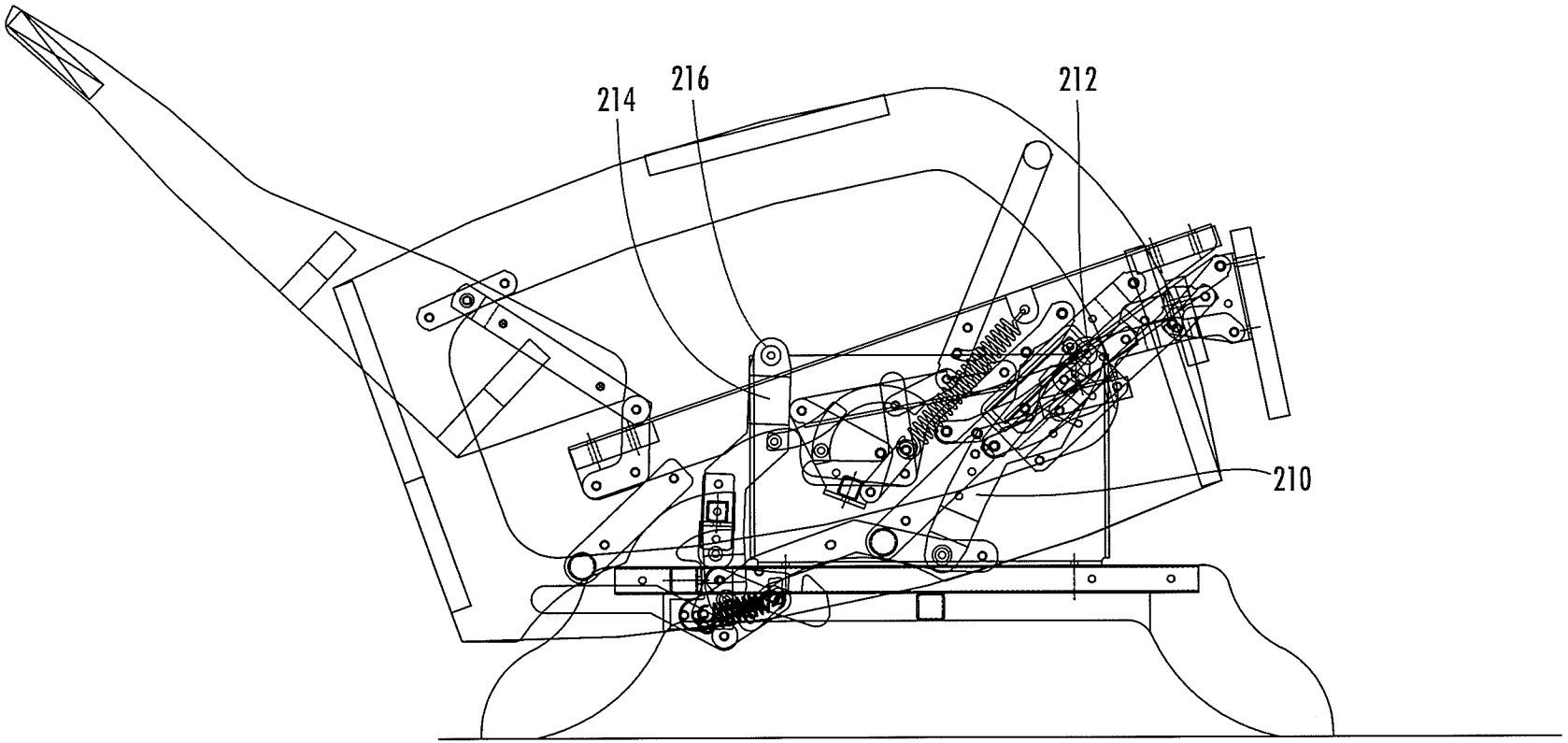
FIG. 13 is a cutaway side view of the chair of FIG. 1 in the position shown in FIG. 11, wherein the chair has glided rearwardly relative to the base.

In operation, the backrest 28 may be moved from the upright position of FIGS. 2 and 5 to the reclined position of FIGS. 8 and 11 through a rearwardly-directed force applied to the backrest 28 (typically via an occupant of the chair 10 pushing rearwardly on the arms 226, such that the occupant's back is pressed into the upper end of the backrest 28). Such a force causes the backrest 28, and in turn the coupling link 46, to rotate (counterclockwise from the vantage point of FIGS. 2 and 5) about the pivot 48. The lower, forward end of the backrest 28 rises slightly and moves forwardly, and in doing so drives the rear seat mounting bracket 42 and, in turn, the seat 22 forwardly. The motion of the front end of the seat 22 follows the movement of the pin 50*a* as it moves forwardly in the slot 54. Motion ceases when the pin 50*a* reaches the forward end of the slot 54. Typically, the seat 22 moves forward between about 2.5 and 6 inches in moving from the upright position to the reclined position.

Notably, the backrest 28 and footrest unit 34 are decoupled from each other, such that the backrest 28 is able to move to the reclined position independent of the position (i.e., retracted or extended) of the footrest unit 34. However, the entire footrest unit 34 moves in concert with the seat 22 in either position.

The backrest 28 is maintained in the reclined position by the contact of the pin 50*a* with the front end of the slot 54. The backrest 28 can be returned to the upright position of FIGS. 2 and 5 by applying a rearwardly-directed force to the lower portion of the backrest 28 (typically by the occupant pressing his back against the lower portion of the backrest 28).

Turning now to FIG. 8, the footrest unit 34 has two footrest mechanisms 60 that attach extendable footrest panels 61*a*, 61*b*, 61*c* to the seat frame 24. The footrest mechanisms 60 move the footrest panels 61*a*, 61*b*, 61*c* between retracted positions below a front portion of the seat 22 (FIGS. 2-4 and 11-13) to extended positions in front of the seat 22 (FIGS. 5-10). Like the reclining mechanism 40, the footrest mechanisms 60 are mirror images of each other about the vertical bisecting plane; consequently, only one of the footrest mechanisms 60 will be described herein, with the understanding that such description is applicable to the other footrest mechanism 60. For the sake of clarity, the footrest mechanism 60 will be described initially with respect to FIG. 8, in which the backrest 28 is in its reclined position and the footrest unit 34 is in its extended position.

Figure 14A:
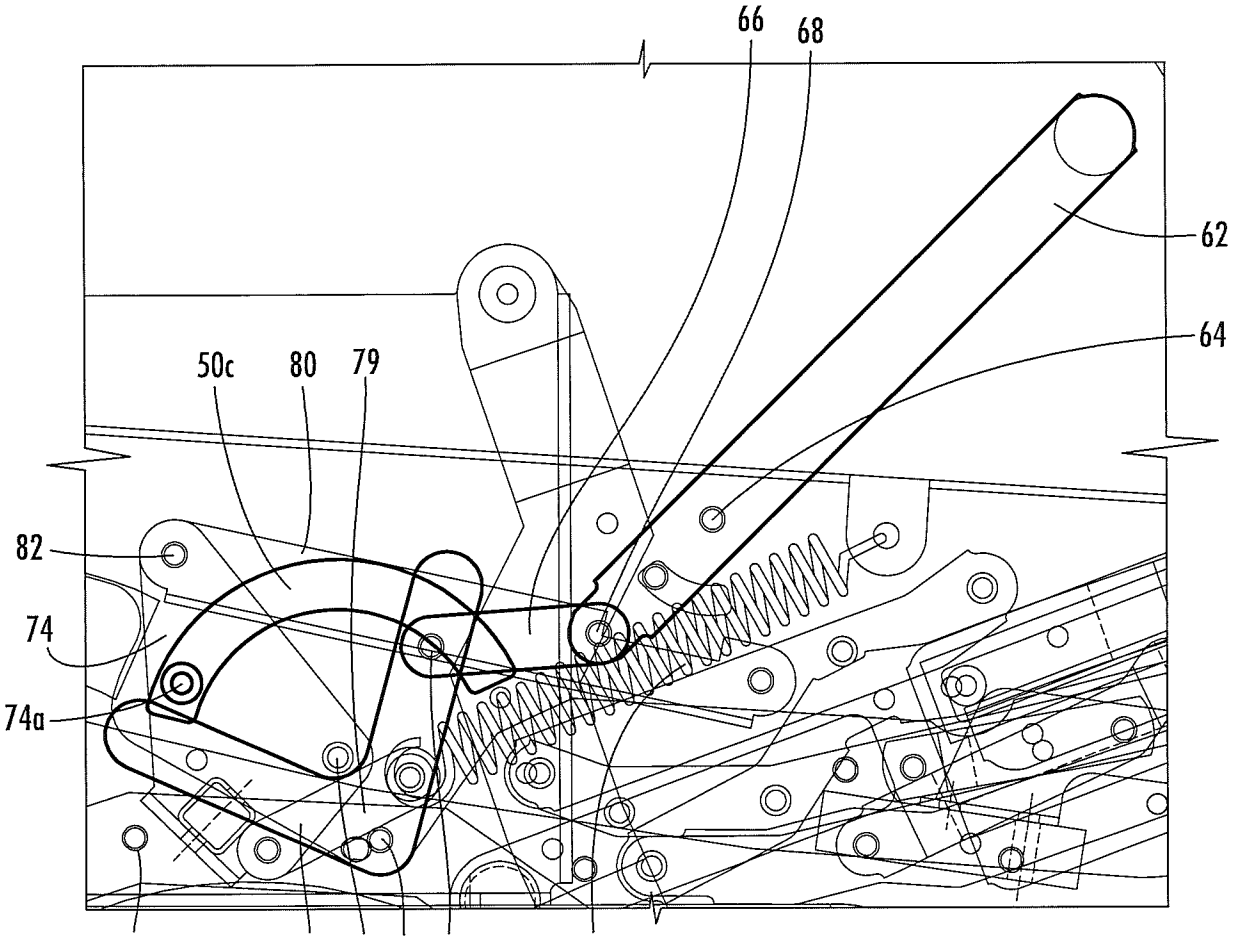
FIG. 14A is an enlarged view of the actuating mechanism of the chair of FIG. 1 with the actuating mechanism shown prior to actuation.
Figure 14B:
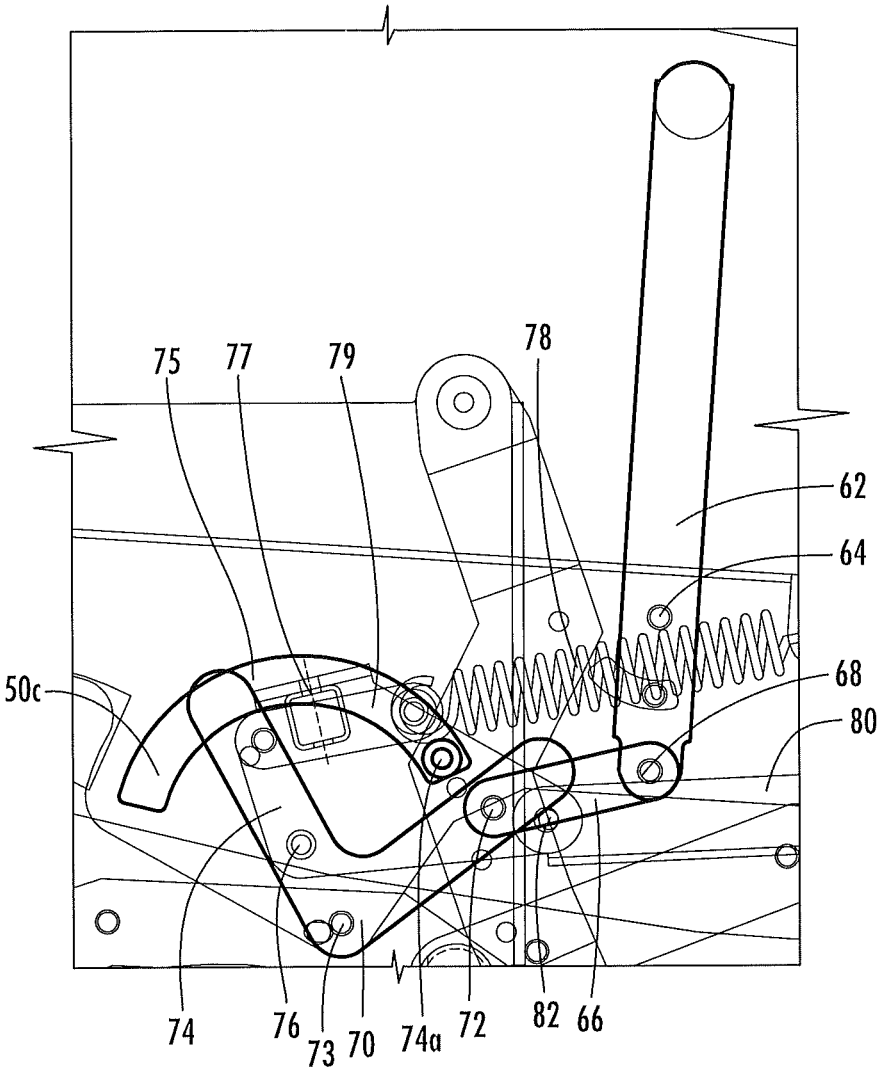
FIG. 14B is an enlarged view of the actuating mechanism of FIG. 14 after actuation.

The footrest mechanism 60 includes an actuating handle 62 that is attached to the seat mounting bracket 50 at a pivot 64 (see also FIGS. 1, 14A and 14B). The graspable portion of the handle 62 extends generally upwardly therefrom and is located inboard of the adjacent arm 16. The lower portion of the handle 62 is pivotally attached to a drawing link 66 at a pivot 68. The drawing link 66 extends rearwardly from the pivot 68 to terminate in a pivot 72 with a V-shaped crank 70. The crank 70 extends downwardly and rearwardly from the pivot 72 to a pivot 73 with the seat mounting bracket 50, then rearwardly and upwardly therefrom. A drive plate 74 is pivotally attached to the seat mounting plate 50 at a pivot 76; a cross-member 77 spans the drive plates 74 of the footrest mechanisms 60 on each side of the chair 10. Also, a pin 74*a* is mounted to the drive plate 74 and extends into an arcuate slot 50*c* in the seat mounting bracket 50. A spring link 79 is attached to the drive plate 74 at a pivot 75. A spring 78 is attached between a forward portion of the spring link 79 and the seat mounting bracket 50; the spring 78 is in tension.

Referring again to FIG. 8, a footrest drive link 80 is attached to the forward end of the drive plate 74 at a pivot 82 and extends generally forwardly and slightly upwardly therefrom. A lower footrest swing link 84 is attached to the seat mounting bracket 50 at a pivot 86 and extends generally forwardly therefrom, and an upper footrest swing link 88 is attached to the seat mounting bracket 50 at a pivot 90 that is positioned slightly upwardly and forwardly from the pivot 86 and extends generally forwardly therefrom. The footrest drive link 80 is attached to the lower footrest swing link 84 at a pivot 87. An upper footrest extension link 92 is attached to the forward end of the lower footrest swing link 84 at a pivot 94 and extends forwardly and upwardly therefrom. Similarly, a lower footrest extension link 100 is attached to the upper footrest swing link 88 at a pivot 102 and extends forwardly and upwardly therefrom. The upper footrest extension link 92 is also pivotally attached to the upper footrest swing link 88 at a pivot 98. The upper footrest extension link 92 also includes a pin 96 between the pivots 94 and 98.

The footrest 61*a* is attached to the footrest mechanism 60 via a rear footrest link 104 that is pivotally attached to the lower footrest extension link 100 at a pivot 106 and extends upwardly and rearwardly therefrom to meet the footrest 61*a*. A brace 108 is attached to the rear footrest link 104 at a pivot 112 and to the upper footrest extension link 92 at a pivot 110. The footrest 61*b* is mounted on a middle footrest bracket 114, which is attached to the upper and lower footrest extension links 92, 100 at pivots 116, 118 respectively. The footrest 61*c* is mounted to a front footrest link 120, which is attached to the middle footrest bracket 114 at a pivot 122 and extends forwardly therefrom to meet the footrest 61*c*. A brace 124 is attached to the front end of the lower footrest extension link 100 at a pivot 126 and to the front footrest link 120 at a pivot 128.

The footrests 61*a*, 61*b*, 61*c* of the chair 10 can be moved between their retracted positions (FIGS. 2 and 11) and their extended positions (FIGS. 5 and 8) through movement of the handle 62. Turning first to FIG. 14A, it can be seen that the handle 62 extends upwardly and forwardly from the pivot 64. The drawing link 66 is generally horizontal and extends rearwardly from the pivot 68, and the crank 70 extends downwardly from the pivot 72 to the pivot 73, then rearwardly to a position below the pin 74*a*, which is located in the rear end of the slot 50*c*. The drive plate 74 is oriented such that the pivot 75 is below the pivot 76. The spring link 79 extends upwardly and forwardly from the pivot 75, with the result that the pivot 75 and the spring 78 create an "over-center" condition. Referring to FIG. 2, the footrest drive link 80 extends generally forwardly from the pivot 82. The upper and lower footrest swing links 88, 84 extend downwardly and rearwardly from their respective pivots 90, 86 with the seat mounting bracket 50, and the upper and lower footrest extension links 92, 100 extend upwardly and forwardly from, respectively, pivots 94, 102. The rear footrest link 104 extends upwardly and forwardly from the pivot 106, such that the footrest 61*a* is generally vertically disposed underneath the forward portion of the seat panel 24. The middle footrest bracket 114 is disposed such that the footrest 61*b* is vertically disposed and generally even with the front of the arms 226. The front footrest bracket 120 extends rearwardly from the pivot 122, such that the footrest 61*c* is positioned below the forward portion of the seat panel 24 and faces downwardly. The footrest mechanism 60 is maintained in the retracted position by an "over-center" condition defined by the ends of the spring 78 and the pivot 76, wherein the spring 78 biases the footrest unit 34 toward the retracted position.

To move the footrests 61*a*, 61*b*, 61*c* from their retracted positions shown in FIGS. 2 and 11 to their extended positions shown in FIGS. 5 and 8, an occupant of the chair 10 applies a rearwardly-directed force to the handle 62, which causes the handle 62 to rotate (counterclockwise from the vantage point of FIG. 2) about the pivot 64. This action pulls the drawing link 66 forward, which in turn draws the forward leg of the crank 70 forward and rotates the crank 70 clockwise about the pivot 73. As the crank 70 rotates, its rear leg strikes the pin 74*a* and forces it forwardly in the slot 50*c*, which in turn forces the drive plate 74 to rotate clockwise about the pivot 76. This motion is encouraged by the tension in the spring 78 after the drive plate 74 rotates sufficiently that the over-center condition between the ends of the spring 78 and the pivot 75 no longer exists. Rotation of the drive plate 74 drives the footrest drive link 80 forward. Forward motion of the footrest drive link 80 rotates the lower footrest swing link 84 counterclockwise about the pivot 86, which action forces the upper footrest extension link 92 forward. The forward movement of the upper footrest extension link 92 rotates the upper footrest swing link 88 counterclockwise about the pivot 90, which in turn drives the lower footrest extension link 100 forward.

The forward movement of the upper and lower footrest extension links 92, 100 unfolds the footrests 61*a*, 61*b*, 61*c*. More specifically, as the upper and lower footrest links 92, 100 move forwardly, the brace 108 rotates counterclockwise about the pivot 110, which action rotates the rear footrest link 104 counterclockwise about the pivot 106. This rotation raises the footrest 61*a* and rotates it counterclockwise to a generally horizontal disposition in front of the seat 22. The movement of the upper and lower footrest extension links 92, 100 also causes the middle footrest bracket 114 and the footrest 61*b* to rotate counterclockwise to a generally horizontal disposition in front of the footrest 61*a*. Finally, the movement of the upper and lower footrest extension links 92, 100 forces the brace 124 forward and rotates it counterclockwise about the pivot 126; this rotation causes the front footrest link 120 to rotate counterclockwise about the pivot 122 to an inverted position, such that the footrest 61*c* is generally horizontally disposed and positioned in front of the footrest 61*b*. Movement of the footrest mechanism 60 ceases when a pin 74*a* on the drive plate 74 strikes the rear edge of the seat mounting plate 50 and the pin 96 contacts the lower edge of the upper footrest swing link 88 (FIGS. 5 and 8).

The footrests 61*a*, 61*b*, 61*c* can be moved back to the retracted position by the occupant pushing the handle 62 forward. As the handle 62 rotates clockwise about the pivot 64, the lower portion of the handle 62 forces the drawing link 66 rearwardly, which in turn rotates the crank 70 counterclockwise about the pivot 73. This movement, combined with the weight of the occupant's legs on the footrests 61*a*, 61*b*, 61*c*, overcomes the "over-center" condition created by the pivots 76, 82, 87, which releases the footrests 61*a*, 61*b*, 61*c* and allows them to collapse into their retracted positions (FIGS. 2 and 11).

The chair 10 is free to glide along a longitudinal path defined by the front and rear glide links 214, 210 with the footrest unit 60 in either the retracted or extended position or with the backrest 28 in either the upright or reclined position (see FIGS. 3, 4, 6, 7, 9, 10, 12 and 13, which show forward and rearward gliding motion of the chair 10 in all permutations of backrest and footrest positions). In particular, the chair 10 is free to glide in the fully reclined position, which is typically not permitted in gliding reclining chairs. In prior gliding reclining chairs, the balance of the chair is such that an occupant gliding while the chair is fully reclined would risk the chair tipping over backward due to the weight of the occupant on the backrest 28. However, because the seat 22 moves forwardly relative to the arm frame 225 when the backrest 28 reclines, the weight of the occupant is also shifted forwardly, which significantly reduces the risk of the chair tipping over backward.

Also, the distance between the upper pivots 212, 216 of the front and rear glide links 210, 214 and their respective lower pivots 222, 224 enables the chair 10 to have a long glide path (typically about 15-20 inches), which can be very relaxing for an occupant of the chair 10. The presence of the glide links 210, 214 within the arms 226 enables these links 210, 214 to extend above the surface of the seat 22, thereby permitting longer links 210, 214 to be used.

Figure 16A:
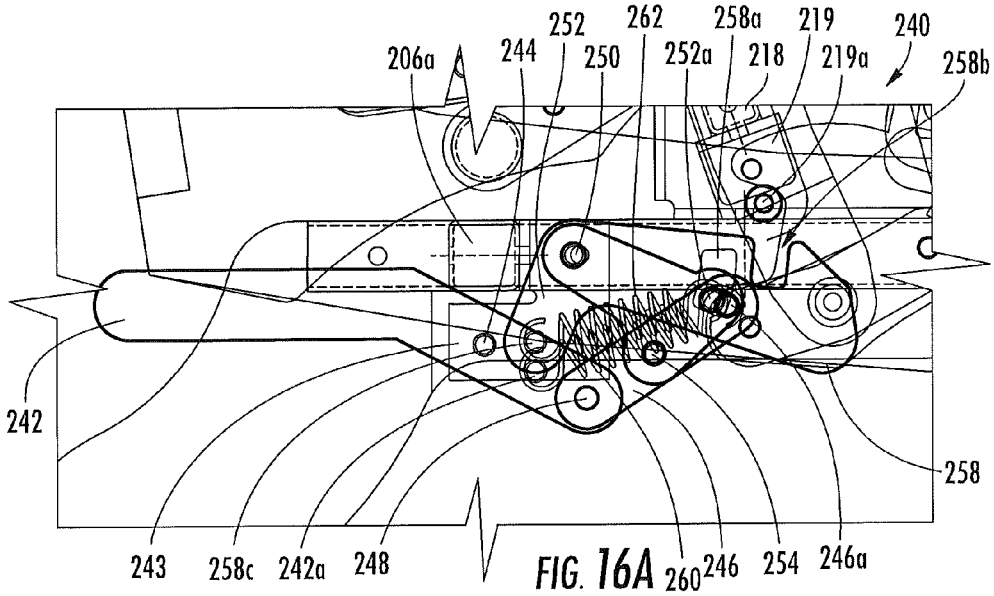
FIG. 16A is an enlarged view of the locking mechanism of the chair of FIG. 1 shown in an unlocked condition.
Figure 16B:
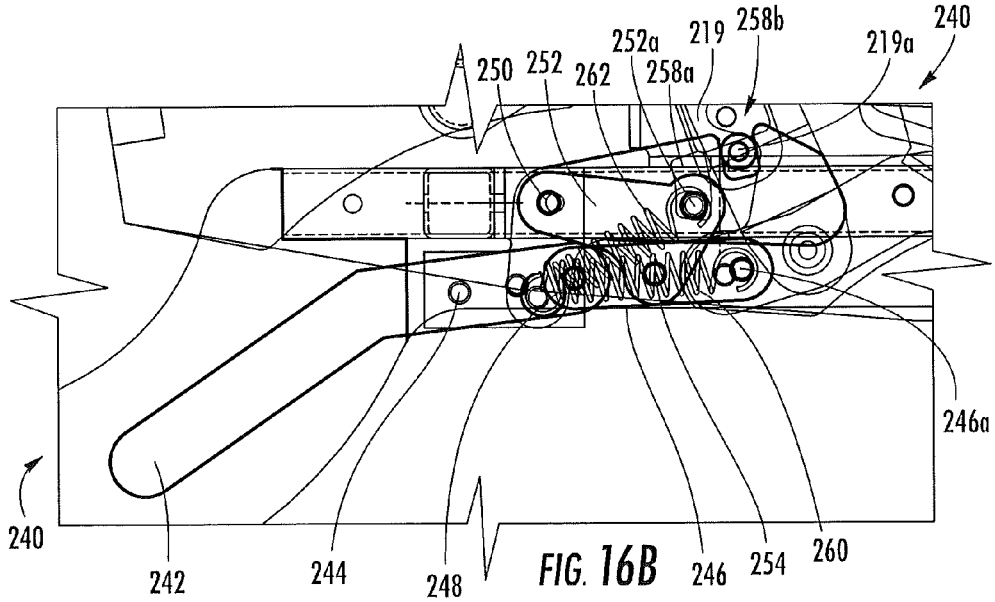
FIG. 16B is an enlarged view of the locking mechanism of FIG. 16A shown in a locked condition.

Referring now to FIGS. 16A and 16B, the chair 10 also includes a glide lock unit 240 that can prevent the chair 10 from gliding in any of the positions described above. The glide lock unit 240 includes a foot pedal 242 that is attached to a flange 243 depending from the cross-member 206*a* at a pivot 244. A drive link 246 is attached to the front end of the foot pedal 242 at a pivot 248. A transition link 252 is attached to the center of the drive link 246 at a pivot 254. The transition link 252 is also attached to the flange 243 at a pivot 250. A locking link 258 is attached to the transition link 252 at the pivot 250 and extends forwardly therefrom. The locking link 258 includes a closed-ended slot 258*a* and an open-end, upwardly-facing pocket 258*b*. A pin 252*a* on the transition link 252 is received in the slot 258*a*. A spring 260 extends between a pin 242*a* on the foot pedal 242 and a pin 246*a* on the drive link 246. A second spring 262 extends between a pin 258*c* on the locking link 258 and the pin 252*a*.

When the glide lock unit 240 is in the unlocked position shown in FIG. 16A, the foot pedal 242 is generally horizontal in extending from the pivot 244. The pin 252*a* is positioned in the lower end of the slot 258*a*. An over-center condition exists between the pivots 244, 248, 254. Both springs 260, 262 are in tension, which urges the locking link 258 to remain in a lowered position.

A user can activate the glide lock unit 240 by depressing the foot pedal 242. This action causes the foot pedal 242 to rotate counterclockwise about the pivot 244 (FIG. 16B). Rotation of the foot pedal 242 forces the drive link 246 upwardly, which in turn rotates the transition link 252 counterclockwise about the pivot 250. Movement of the transition link 252 draws the pin 252*a* upwardly in the slot 258*a*. Also, once the over-center condition between the pivots 244, 248, 254 is overcome, the spring 262 draws the lower end of the locking link 258 forward, thereby rotating the locking link 258 about the pivot 250. As the forward end of the locking link 258 rises, the pocket 258*b* is positioned to receive and capture the pin 219*a* mounted to the flange 219 on the cross-member 218 (which in turn is fixed to the rear glide links 214). Capturing the pin 219*a* in the pocket 258*b* prevents movement of the rear glide links 214 relative to the base 200, therefore preventing gliding movement of the chair 10. The spring 260 maintains the locking link 258 in the locked position due to the "over-center" arrangement of the pivots 244, 248, 254.

Notably, in the locked position of FIG. 16B the locking link 258 is free to rotate clockwise slightly about the pivot 250 until the upper end of the slot 258*a* strikes the pin 252*a*. As a result, the locking link 258 can deflect downwardly (pushed by the pin 219*a*) if the chair 10 has glided to a position in which the pin 219*a* is not positioned immediately above the pocket 258*b*. With the locking link 258 in this deflected position, the pin 219*a* can glide to the capture location. The spring 262 draws the locking link 258 counterclockwise to recover to a locking position once pin 219*a* is in position to be captured in the pocket 258*b*.

The locking link 258 can be disengaged from the pin 219 via lifting of the rear end of the foot pedal 242. This action draws the drive link 246 and the transition link 252 toward their original positions, with the pin 252*a* also drawing the locking link 258 clockwise via the pin 252*a*. Once the "over-center" condition of the pivots 244, 248, 254 is passed, the springs 260, 262 urge the links of the glide lock unit 240 toward their original positions (FIG. 16A).

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A gliding-reclining seating unit, comprising:

a base configured to rest on an underlying surface;

an arm frame;

a gliding mechanism attached to the base and to the arm frame, the gliding mechanism configured to enable the arm frame to reciprocate in a longitudinal direction relative to the base;

a generally horizontally-disposed seat;

a generally upright backrest positioned rearwardly of the seat;

a footrest unit;

a reclining mechanism that interconnects and controls movement of the seat and the backrest relative to the arm frame between an upright position and a reclined position;

wherein in the upright position, the backrest is generally upright and positioned above the arm frame, and the seat has a first rearward position relative to the arm frame; and wherein in the reclined position, the backrest is reclined relative to the underlying surface as compared to its disposition in the upright position and the seat has a second forward position relative to the arm frame that is forward of the first rearward position;

the footrest unit comprising at least one footrest and a footrest mechanism that interconnects the footrest with the seat, the footrest mechanism configured to move the footrest between a retracted position, in which the footrest is positioned beneath the seat, and an extended position, in which the footrest is generally horizontally disposed in front of the seat, the footrest able to move to either of the retracted and extended positions whether the backrest is in the upright or reclined position, and the backrest able to move to either of the upright or reclined positions whether the footrest is in the retracted or extended position;

wherein, when the backrest moves between the upright and reclined positions, the footrest unit moves in concert with the seat relative to the arm frame;

wherein the arm frame is free to reciprocate relative to the base when the backrest is in either of the upright position and the reclined position.

2. The seating unit defined in claim 1, wherein the arm frame is free to reciprocate relative to the base when the footrest unit is in either of the retracted position and the extended position.

3. The seating unit defined in claim 1, wherein in reciprocating relative to the base, the arm frame is free to move between about 9 and 13 inches relative to the base.

4. The seating unit defined in claim 1, wherein the gliding mechanism includes a rear glide link pivotally attached to the base and to the arm frame at respective first and second pivots, and a front glide link pivotally attached to the base and the arm frame at respective third and fourth pivots.

5. The seating unit defined in claim 4, wherein the first and second pivots are between 6 and 10 inches apart, and the third and fourth pivots are between about 6 and 10 inches apart.

6. The seating unit defined in claim 4, wherein the arm frame includes arms on opposite sides thereof, and wherein each of the arms includes an internal cavity, and wherein the front and rear glide links are positioned within an arm cavity.

7. The seating unit defined in claim 1, wherein the footrest mechanism is actuated by a handle, and wherein the handle is pivotally mounted on the seat.

8. The seating unit defined in claim 7, wherein the arm frame includes arms on opposite sides thereof, and wherein the handle is mounted inboard of the arms.

9. The seating unit defined in claim 7, wherein the handle is attached to an actuating unit, and wherein the actuating unit comprises:

a drawing link pivotally attached to the handle;

a crank pivotally attached to the drawing link and to the seat;

a drive plate pivotally attached to the seat;

a spring link pivotally attached to the drive plate; and a spring attached to the spring link and to the seat.

10. The seating unit defined in claim 1, further comprising a locking mechanism attached to the base, the locking mechanism being configured to lock the arm frame relative to the base to prevent relative movement thereof.

11. The seating unit defined in claim 10, wherein the locking mechanism is configured to be operative whether the backrest is in the reclined position or in the upright position, and whether the footrest mechanism is in the retracted position or the extended position.

12. A gliding-reclining seating unit, comprising:

a base configured to rest on an underlying surface;

an arm frame having arms on opposite sides thereof;

a gliding mechanism attached to the base and to the arm frame, the gliding mechanism configured to enable the arm frame to reciprocate in a longitudinal direction relative to the base;

a generally horizontally-disposed seat;

a generally upright backrest positioned rearwardly of the seat;

a footrest unit;

a reclining mechanism that interconnects and controls movement of the seat and the backrest relative to the arm frame between an upright position and a reclined position;

wherein in the upright position, the backrest is generally upright and positioned above the arm frame, and the seat has a first rearward position relative to the arm frame; and wherein in the reclined position, the backrest is reclined relative to the underlying surface as compared to its disposition in the upright position and the seat has a second forward position relative to the arm frame that is forward of the first rearward position;

the footrest unit comprising at least one footrest and a footrest mechanism that interconnects the footrest with the seat, the footrest mechanism configured to move the footrest between a retracted position, in which the footrest is positioned beneath the seat, and an extended position, in which the footrest is generally horizontally disposed in front of the seat, able to move to either of the retracted and extended positions whether the backrest is in the upright or reclined position, and the backrest able to move to either of the upright or reclined positions whether the footrest is in the retracted or extended position;

wherein, when the backrest moves between the upright and reclined positions, the footrest unit moves in concert with the seat relative to the arm frame;

wherein the footrest mechanism is actuated by a handle pivotally mounted to the seat, and wherein the handle is positioned inboard of the arms.

13. The seating unit defined in claim 12, wherein the arm frame is free to reciprocate relative to the base when the backrest is in either of the upright position and the reclined position and further is free to reciprocate relative to the base when the footrest unit is in either of the retracted position and the extended position.

14. The seating unit defined in claim 12, wherein the gliding mechanism includes a rear glide link pivotally attached to the base and to the arm frame at respective first and second pivots, and a front glide line pivotally attached to the base and the arm frame at respective third and fourth pivots.

15. The seating unit defined in claim 14, wherein the first and second pivots are between 6 and 10 inches apart, and the third and fourth pivots are between about 6 and 10 inches apart.

16. The seating unit defined in claim 14, wherein each of the arms includes an internal cavity, and wherein the front and rear glide links are positioned within an arm cavity.

17. The seating unit defined in claim 12, further comprising a locking mechanism attached to the base, the locking mechanism being configured to lock the arm frame relative to the base to prevent relative movement thereof.

18. The seating unit defined in claim 17, wherein the locking mechanism is configured to be operative whether the backrest is in the reclined position or in the upright position, and whether the footrest mechanism is in the retracted position or the extended position.

* * * * *